United States Patent [19]

Kotick

[11] Patent Number: 5,064,159

[45] Date of Patent: Nov. 12, 1991

[54] ARTICLE HOLDER UTILIZING MAGNETOSTATIC INTERACTION

[76] Inventor: Arthur Kotick, 333 Pearl St., New York, N.Y. 10038

[21] Appl. No.: 468,365

[22] Filed: Jan. 22, 1990

[51] Int. Cl.[5] ..... A47K 5/00

[52] U.S. Cl. ..... 248/309.4

[58] Field of Search ..... 248/683, 205.3, 309.4, 248/314, 206.5; 335/285; 206/350, 818; 401/131; 211/DIG. 1; 24/303

[56] References Cited

U.S. PATENT DOCUMENTS

| | | | |
|---|---|---|---|
| 2,385,859 | 10/1945 | Jacobson | 248/309.4 |
| 2,597,925 | 5/1952 | Edger | 248/309.4 |
| 2,642,999 | 6/1953 | McPherson | 248/309.4 |
| 2,825,177 | 3/1958 | Nordlof | 248/309.4 |
| 2,960,237 | 4/1959 | McEnery | 248/309.4 |
| 3,239,178 | 11/1967 | Pompa | 248/205.3 |
| 3,289,990 | 9/1968 | Grantham | 248/205.3 |
| 3,533,035 | 10/1970 | Gili | 248/309.4 |
| 3,552,705 | 1/1971 | Caster | 248/309.4 |
| 4,207,975 | 6/1980 | Arzillo | 248/309.4 |

FOREIGN PATENT DOCUMENTS

| | | | |
|---|---|---|---|
| 247119 | 2/1926 | United Kingdom | 335/285 |
| 646854 | 11/1950 | United Kingdom | 211/DIG. 1 |
| 880914 | 10/1961 | United Kingdom | 248/309.4 |

*Primary Examiner*—Ramon O. Ramirez
*Assistant Examiner*—Robert A. Olson
*Attorney, Agent, or Firm*—Natter & Natter

[57] ABSTRACT

An article holder utilizing magnetostatic interaction includes a plastic mounting block having an embedded magnetic core. Access to a contact surface of the magnetic core is provided by a bore extending internally from a face of the block. A magnetically attractable disc is attachable to a distal end of an elongate article and is further insertable within the bore for magnetic retention in a suspended storage mode. A counting module includes a matrix of openings for receiving a pin member which is hand positionable within one of said openings for denoting a particular occurrence.

9 Claims, 1 Drawing Sheet

FIG. 1
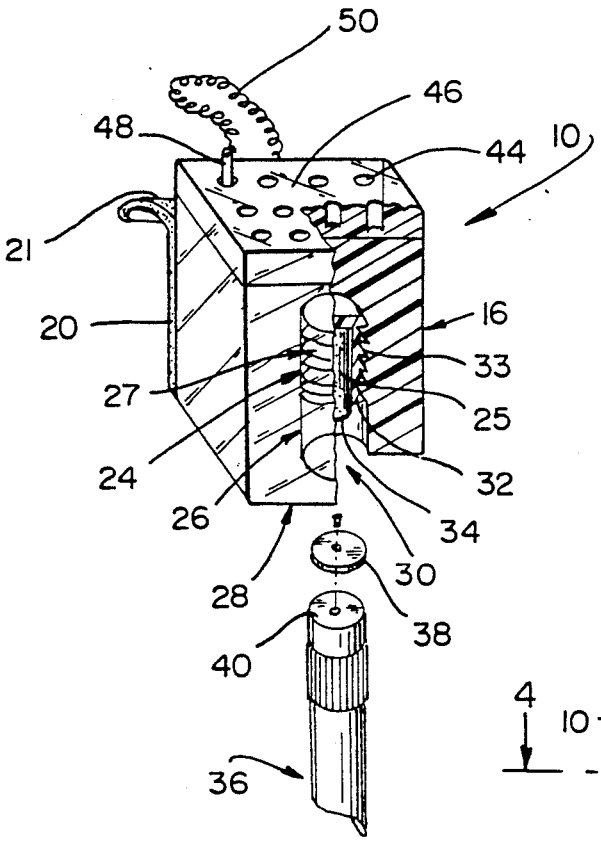
FIG. 3
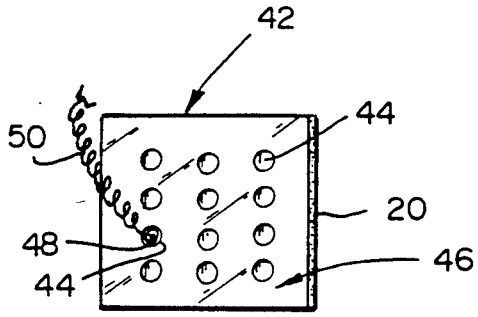
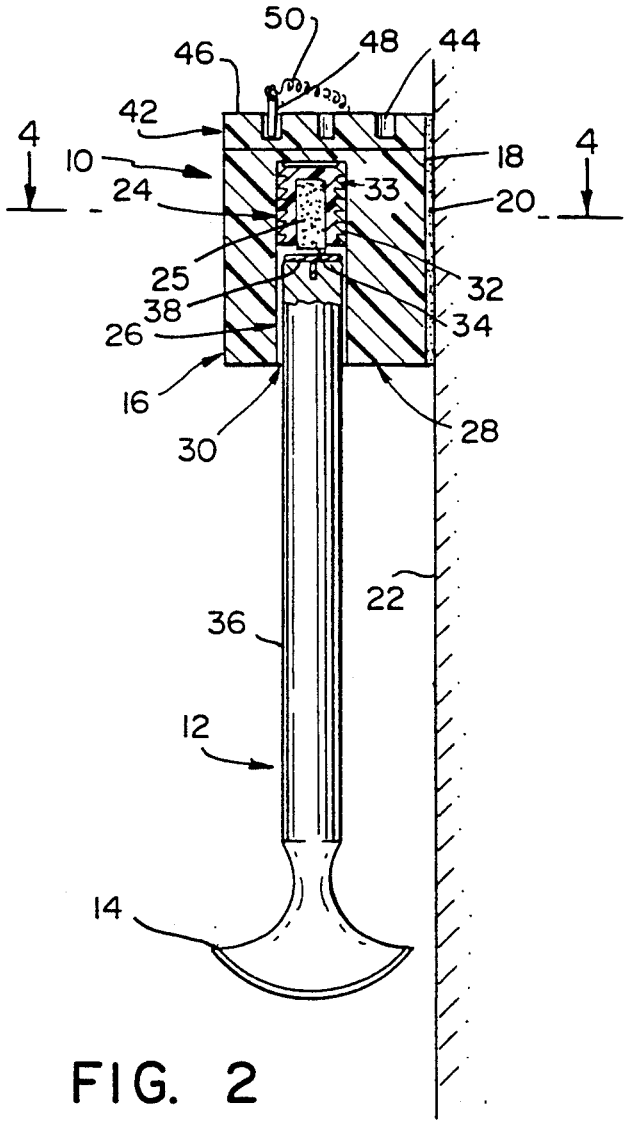
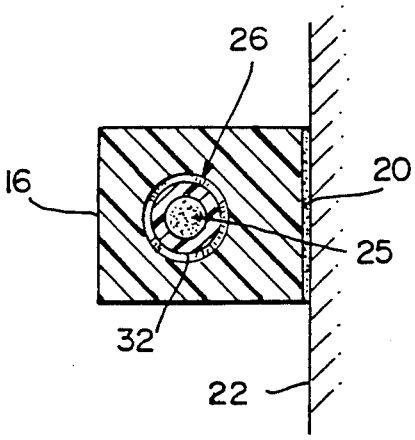
FIG. 4
FIG. 2

ARTICLE HOLDER UTILIZING MAGNETOSTATIC INTERACTION

TECHNICAL FIELD

This invention relates generally to article holders and especially to a device that utilizes magnetostatic interaction for suspending an object.

In particular, the article holder of this invention concerns a device for releasably securing an article in a suspended storage mode and for monitoring each occurrence of article usage.

BACKGROUND ART

Numerous devices have applied magnetic attraction for supporting miscellaneous objects. The general application of this concept is shown in U.S. Pat. No. 3,239,178 wherein a wall mounted disc-shaped magnet is securable within a complementary housing mounted to another surface. A disadvantage of that device, however, is that the disc magnet and housing are not suitable for supporting an elongate article at a terminal end having a small cross-sectional area.

An apparatus for magnetically supporting an article at its end is shown in U.S. Pat. No. 3,289,990. A problem with that device is that it requires the embedment of a magnetic rod or a magnetically attractive screw within the article such as a bar of soap. This is not practical for all objects. The use of an elastomer cup at the terminal end provides similar shortcomings and increases manufacturing costs.

Another holding device as disclosed in U.S. Pat. No. 2,642,999, utilized a magnet having a disc portion and a ring portion. A deficiency of that device is that the magnetic surfaces tend to attract other metal objects exposed to the magnetic field.

An application of magnetic members in conjunction with a safety razor is shown in U.S. Pat. No. 2,385,859 and in U.S. Pat. No. 2,960,237. The first-mentioned patent shows a safety razor having a magnet embedded in a knob of the razor handle. The purpose of the magnet is for attracting a razor blade and it is not used as a razor holder. Similarly, the second mentioned patent utilizes a magnet embedded within a case for securing a package of razor blades; the razor itself is held by a flange.

Furthermore, the aforementioned holder devices do not incorporate a structure for registering occurrences of article usage.

BRIEF DESCRIPTION OF THE INVENTION

To briefly summarize, this invention concerns a multiple-face mounting block comprised of a nonmagnetic material. The block is adhesively secured along one of said block faces, to a support wall. The mounting block contains an embedded magnetic core preferably of a permanently magnetized ferromagnetic material. Access to the magnetic core is provided by a bore extending internally from a face of the block and defining an opening in said block face.

A distal end of a safety razor handle is provided with a segment of magnetically attractive material or alternatively is provided with a magnetic segment of opposite polarity to a contact surface of the magnetic core. The distal end of the handle is adapted to be accommodatingly received within the bore for registered alignment with the magnetic core.

In addition, the mounting block is provided with a counting module secured along another surface of the block. In one embodiment, the counting module is comprised of a matrix of openings within the block and includes a pin or peg member tethered to the block. The pin member is hand-positioned sequentially within the openings, for example, in correspondence with daily usage of the razor blade.

A mechanical register, an electronic counting module, an electromechanical counter or equivalent counting mechanism as is known in the art, can be substituted to provide other indicia and/or cumulative count. Additionally, the counting mechanism can be actuated automatically in response to engagement and/or disengagement of the safety razor with the mounting block.

A feature of this invention is that the bore provides guided access to a contact surface of the magnetic core. Another advantage of this arrangement is that the recessed access to the magnetic core shields the magnetic field to prevent unintentional attraction of other objects. Furthermore, the accessing of the magnetic core through the bore improves the magnetic retention of the article.

In view of the foregoing, it should be apparent that the present invention overcomes many of the shortcomings and deficiencies of the prior art and provides an improved magnetic holder.

Having thus summarized the invention, it will be seen that it is an object thereof to provide an article holder utilizing magnetostatic interaction of the general character described herein which is not subject to the aforementioned disadvantages, shortcomings or deficiencies.

Another object of this invention is to provide an article holder utilizing magnetic interaction for releasably securing a safety razor in a suspended storage mode.

A further object of this invention is to provide an article holder having a magnetic core and a bore for providing recessed access to a contact surface of the magnetic core.

A further object of this invention is to provide an article holder wherein a distal end of a safety razor handle can be guidingly accommodated within the bore and magnetically retained in a suspended storage mode.

Still another object of this invention is to provide an article holder having a counting module for registering blade usage or other data.

A still further object of this invention is to provide an article holder which is simple in construction, low in cost, reliable in use and well adapted for mass production fabrication.

Other objects of this invention in part will be apparent and in part will be pointed out hereinafter.

With these ends in view, the invention finds embodiment in certain combinations of elements and arrangements of parts by which the aforementioned objects and certain other objects are hereinafter attained all as more fully described with reference to the accompanying drawings and the scope of which is more particularly pointed out and indicated in the appended claims.

BRIEF DESCRIPTION OF THE DRAWINGS

In the accompanying drawings in which is shown an exemplary embodiment of the invention:

FIG. 1 is a perspective view of an article holder utilizing magnetostatic interaction of this invention with a portion removed for showing a magnetic core embedded within a mounting block with a bore providing access to the magnetic core, and further illustrating in exploded fashion, a metal disc attachable to a distal end of a safety razor handle;

FIG. 2 is an elevational view, partially in section showing the article holder of this invention adhesively secured along a side face of the mounting block to a support surface;

FIG. 3 is a plan view showing the matrix of openings in an upper face of the mounting block a pin within an opening; and FIG. 4 is a sectional view taken substantially along line 4—4 of FIG. 2 showing in detail the magnetic core with a surrounding sleeve frictionally engaged within the bore.

DETAILED DESCRIPTION OF THE INVENTION

Referring now in detail to the drawings, the reference numeral 10 denotes generally an article holder utilizing magnetostatic interaction in accordance with this invention.

The article holder 10 will be described hereinafter in combination with an elongate article such as a safety razor 12. The safety razor 12 is intended for use with an expendable razor blade 14.

The article holder 10 includes a multiple-face mounting block 16 which for the purpose of illustration, is shown as a rectangular block and is fabricated of a transparent acrylic material. Typical dimensions of the block 16 are 2 in. in height, 1 ½ in. in width and 1 in. in depth.

A side face 18 of the block 16 is provided with an adhesive material 20 which is preferably covered with a peelable backing 21. The mounting block 16 can readily be secured to a support surface 22 such as within the medicine chest, by use of the adhesive layer 20.

A magnetic core 24 is embedded within the block 16 and can be inserted therein through a bore 26 extending internally from a bottom face 28 of the block 16 and providing an access opening 30.

The magnetic core 24 includes a cylindrical magnet 25 within a resilient plastic sleeve 32. The core 24 is frictionally secured within the bore 26. The sleeve 32 can further be provided with a plurality of ridges 33 or can be externally threaded for providing improved gripping or threadable contact with the bore 26.

By way of example, the bore 26 extends longitudinally within the block 16 approximately 3 cms. and has a diameter of approximately 1.5 cms. The core magnet 24 is 1.5 cms. in length and has a diameter including the thickness of the sleeve 32 of 1.4 cms.

A contact surface 34 of the magnetic core 24 is recessed approximately 1.5 cms. from the access opening 30. It should be noted that the acrylic material shields the magnetic field emanating from the magnetic core 24 and that an article must be inserted within access opening 30 in confronting relationship with the contact surface 34 to be magnetically retained within the block 16.

The safety razor 12 includes an elongate handle portion 36 which is conventionally fabricated of plastic material and thus is not magnetically attracted by the magnetic core 24. A segment of the magnetically attractive material such as a metal disc 38 is riveted, bonded or otherwise secured to a distal end 40 of the handle 36. In lieu of the metal disc 38 a magnetic disc (not shown) can be substituted for interaction with the magnetic core 24. In all other respects, the safety razor 12 conforms to a conventional safety razor as is currently marketed.

A counting module 42 can be separately incorporated or formed integrally with the block 16. As shown in FIGS. 2 and 3 a matrix of openings 44 has been provided in an upper face 46 of the block 16. In the embodiment shown, twelve such openings 44 are provided and each extends to a depth of approximately 1 cm. The openings 44 are approximately 4 mm. in diameter and are adapted to receive a pin member 48 approximately 1.8 cms. in length. The pin member 48 is tethered to the block 16 by a cable or chain 50. The counting module 42 can in addition include information adjacent each of the openings 44 such as numerals, or other indicia; the openings 44 can also be color coded.

In use, the safety razor 12 is removed from the block 16 by a gentle downward force to overcome the magnetic interaction between the disc 38 and the core 24. After the user has completed the shaving operation, the distal end 40 of the handle 36, is readily insertable within the access opening 30 for engagement with the recessed contact surface 34. The safety razor 12 is magnetically retained in a substantially vertical, space-saving orientation, as showing in FIG. 2, which also facilitates the drainage of water from the blade 14. It should be noted that the bore 26 provides a socket for facilitating registration of the metal disc 38 on the distal end 40 of the handle 36, with the contact surface 34 of the magnetic core 24. Furthermore, the bore 26 serves to stabilize safety razor 12 in magnetic retention and guards against contact with other objects or the user's hand, to thus prevent inadvertent disengagement of the safety razor 12 from the block 16.

The pin member 48 can be hand-positioned sequentially within the openings 44 in correspondence with daily usage of the safety razor 12 and can be used for example, to measure blade life or other occurrences. Other counting modules could be substituted for achieving the same or similar results.

It should therefore be seen that there is provided an article holder utilizing magnetostatic interaction which achieves the various objects of this invention and which is well adapted to meet conditions of practical use.

Since various possible embodiments might be made of the present invention or modifications might be made to the exemplary embodiments above set forth, it is to be understood that all materials shown and described in the accompanying drawings are to be interpreted as illustrative and not in a limiting sense.

Having thus described the invention, there is claimed as new and desired to be secured by Letters Patent:

1. An article holder utilizing magnetostatic interaction comprising a mounting block, a magnetic core embedded within said block, bore means for providing access to the magnetic core, said bore means being adapted for guidingly accommodating an elongate article, said article being releasably retained within said bore by magnetostatic interaction with the magnetic core, counting means for denoting each occurrence of either engagement or disengagement of the article with the mounting block, the counting means including a module having a matrix of openings, said module being affixed to the block, and a pin member, said pin member being adapted for insertion within a selected opening for monitoring article usage.

2. An article holder as claimed in claim 1 wherein the pin member is tethered to the block and is further hand-positionable sequentially within the matrix of openings for denoting a designated occurrence.

3. An article holder as claimed in claim 1 wherein the elongate article is a safety razor, said razor having a handle, a distal end of said handle being insertable within said bore for magnetic retention of the razor in a suspended storage mode.

4. An article holder as claimed in claim 1 wherein the mounting block includes a plurality of faces, one of said faces being provided with fastening means for securing the mounting block to a support surface.

5. An article holder as claimed in claim 1 wherein the magnetic core includes a resilient sleeve member for providing frictional retention within the bore.

6. A magnetic holder in combination with a safety razor, said safety razor having an elongate handle, said holder comprising a mounting block, said block having a plurality of faces, a magnetic core centrally located within said block and defining a recessed magnetic contact surface, bore means extending within the block from a first face and being registrable with the magnetic contact surface, said bore means further defining an access opening in said face, a magnetically attractable disc secured to a distal end of the razor handle, said bore means being adapted to guidingly accommodate an upper portion of the razor handle for positioning the disc contiguous to the magnetic contact surface and for stabilizing the razor in a substantially vertical orientation during magnetic retention with a lower portion of the razor handle being positioned externally of the bore, fastening means for securing a second face of the block to a support surface, said block further having indicator means on a third face of the block for denoting frequency of razor usage, said indicator means including a counter module.

7. A magnetic holder for a safety razor as claimed in claim 6 wherein the counter module includes a matrix of openings extending toward the third face of the block.

8. A magnetic holder for a safety razor as claimed in claim 7 further including a pin member selectively insertable into said openings.

9. A magnetic holder for a safety razor as claimed in claim 7 further including indicia means for differentiating between the several openings.

* * * * *